United States Patent [19]

Wang

[11] Patent Number: 5,038,801

[45] Date of Patent: Aug. 13, 1991

[54] NO-SMOKE ASHTRAY

[76] Inventor: Jung N. Wang, No. 19 Alley 7, Lane 252, Hsi Shu Rd., Tainan, Taiwan

[21] Appl. No.: 461,719

[22] Filed: Jan. 8, 1990

[51] Int. Cl.[5] ..... A24F 13/18

[52] U.S. Cl. ..... 131/236; 131/231

[58] Field of Search ..... 131/231, 236

[56] References Cited

U.S. PATENT DOCUMENTS

| | | | |
|---|---|---|---|
| 1,699,160 | 1/1929 | Roos | 131/236 |
| 1,897,356 | 2/1933 | Baldwin | 131/236 |
| 2,638,905 | 5/1953 | Morrison | 131/236 |
| 3,920,028 | 11/1975 | Kobayakawa | 131/236 |
| 4,018,235 | 4/1977 | Smith | 131/236 |
| 4,346,719 | 8/1982 | Hilkene | 131/236 |
| 4,890,632 | 1/1990 | Diamond | 131/231 |
| 4,953,571 | 9/1990 | Tremblay | 131/231 |

FOREIGN PATENT DOCUMENTS

| | | | |
|---|---|---|---|
| 2611446 | 9/1988 | France | 131/236 |

*Primary Examiner*—V. Millin
*Assistant Examiner*—Lynne A. Reichard
*Attorney, Agent, or Firm*—Varndell Legal Group

[57] ABSTRACT

A no-smoke ashtray comprising a cap consisting of a ring-shaped upper portion and a round plate-shaped lower portion linked together with three feet and a body having two circumferential vertical and bottom walls sandwiching a hollow space to store water therein and a central hollow tube extending upward from the bottom for placing a sponge therein to absorb slowly the water stored in the hollow space so that cigarette butts can be put out when put on the wet sponge in the central tube.

5 Claims, 2 Drawing Sheets

NO-SMOKE ASHTRAY

BACKGROUND OF THE INVENTION

Common traditional ashtrays are very simple without any device for extinguishing a cigarette butt, so smokers have to put out the cigarette by directly compressing butts in a ashtray. However, the cigarette butt often still gives out smoke to pollute the air in a room because of carelessness in putting out the butt.

This invention has been devised to furnish a safe no-smoke ashtray to enable the complete extinguishing of a cigarette butt by means of water so as to eliminate air pollution by second-hand smoke.

SUMMARY OF THE INVENTION

This invention comprises a cap and a body as its main parts.

The cap has an upper portion and a lower portion and the upper portion is shaped like a ring to sit on the circumferential edge of the body and is provided with a plurality of crosswise recesses on its surface and three feet extending down and linking with the lower portion, which is a round plate having its surface slanting down radially with a central opening for an extinguishing tube of the body to extend through upward.

The body is round and provided with two, one inner and one outer, peripheral and bottom walls defining therebetween a hollow space for storing water and an extinguishing tube at the center extending upright and passing through the central opening in the lower portion of the cap. The tube has a sponge therein to absorb water contained in the hollow space for putting out or extinguishing lighted cigarette butts when they are placed on the surface of the sponge.

DETAILED DESCRIPTION OF THE INVENTION

Figure 1:
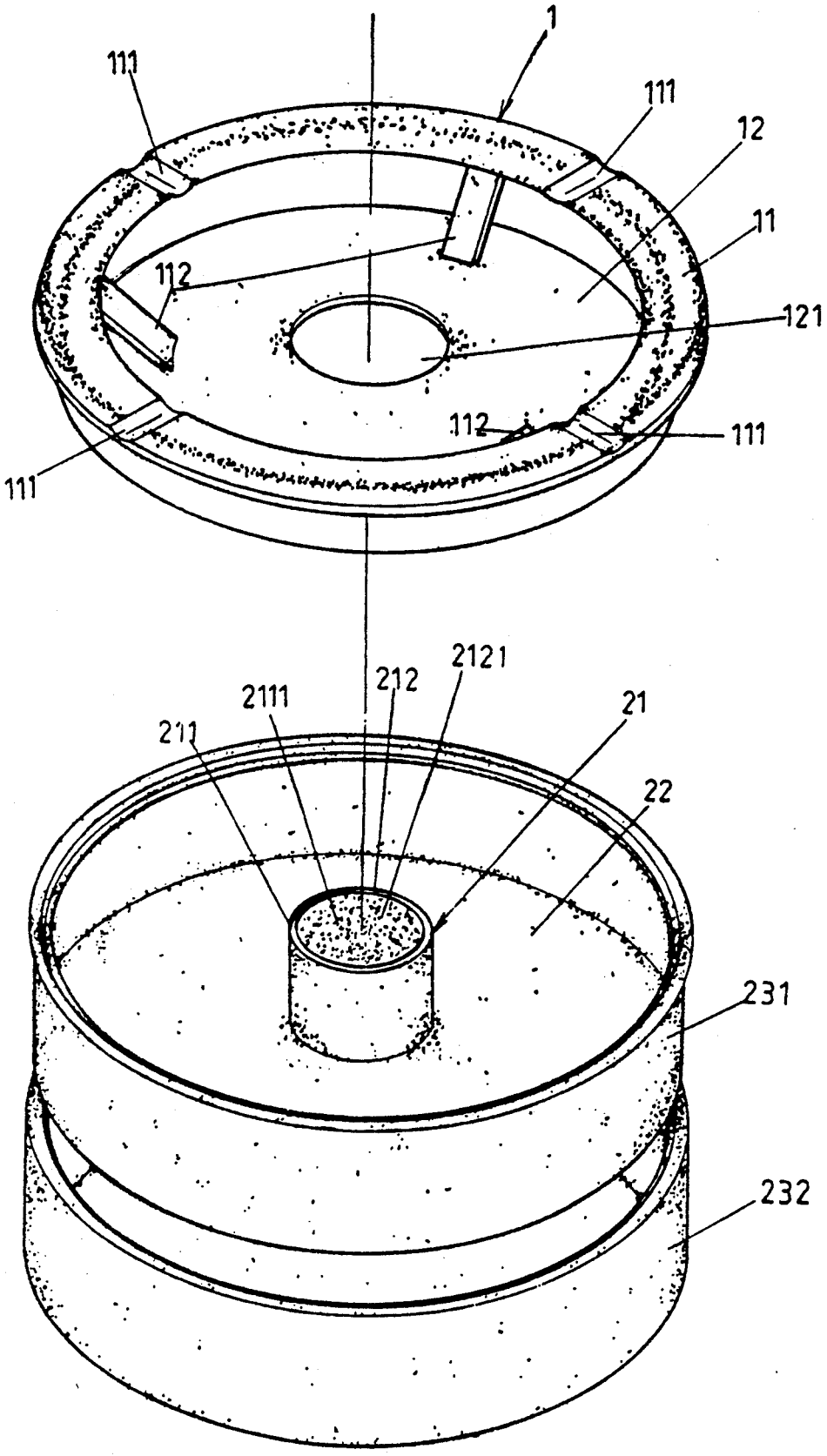
FIG. 1 is an exploded perspective view of the no-smoke ashtray in the present invention.

As FIG. 1 shows, this no-smoke ashtray comprises a cap 1 and a body 2 as its main parts.

Figure 2:
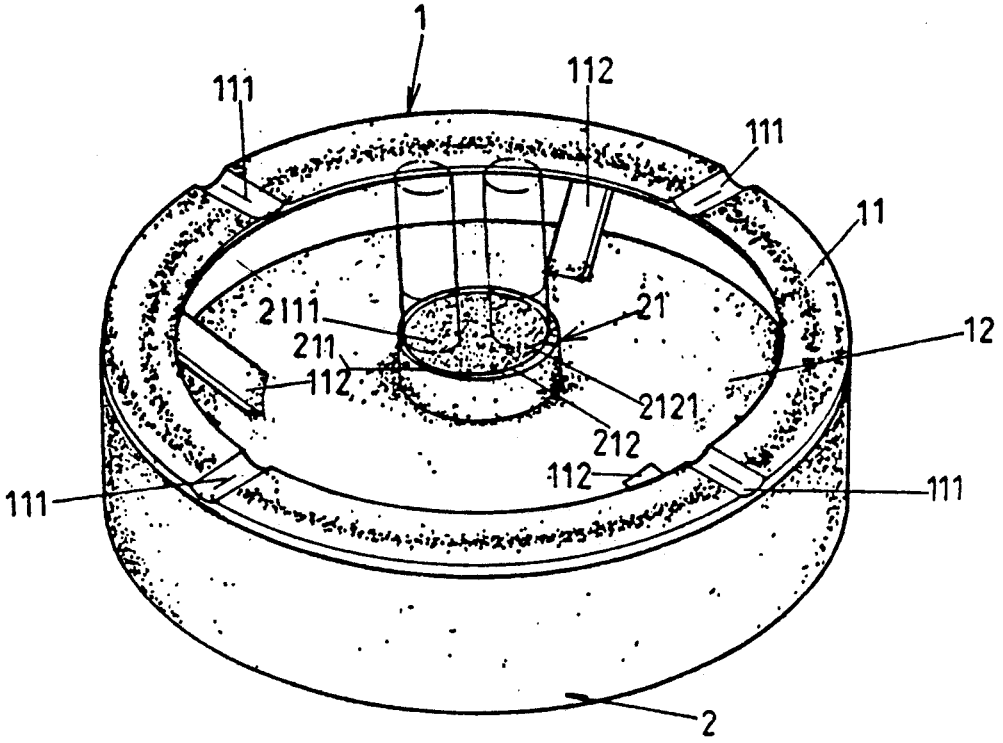
FIG. 2 is a perspective view of the no-smoke ashtray in the present invention.
Figure 3:
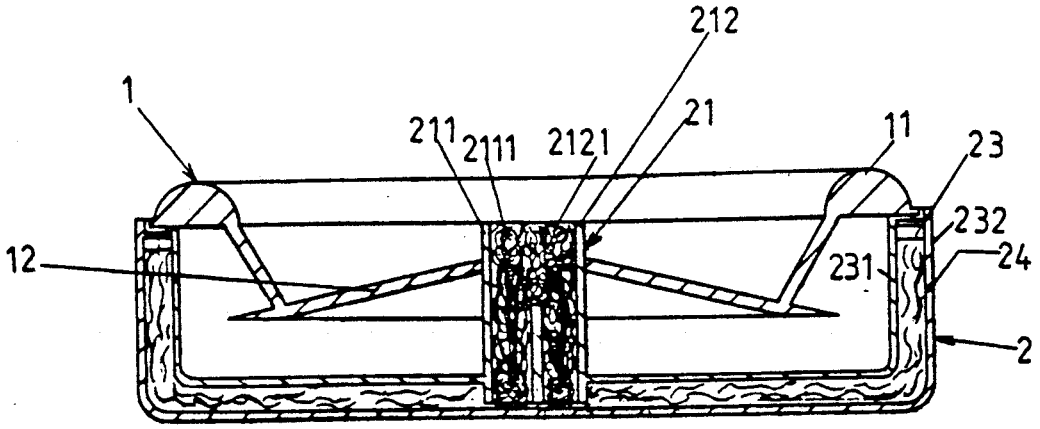
FIG. 3 is a cross-sectional view of the no-smoke ashtray in the present invention.

The cap 1 includes an upper portion 11 shaped as a ring to sit on the peripheral edge of the body 2 and a lower portion 12 of a round shape. The upper portion 11 has a plurality of recesses 111 properly spaced apart on the peripheral surface for placing a lighted cigarette thereon, and three feet extending downward and linking with the lower portion. The lower portion 12 is shaped as a radially slanting down round plate for cigarette butts or ash to fall down in the bottom of the body, and has a central opening 121 for an extinguishing tube 21 of the body to pass therethrough upward above the surface of the lower portion 12, as shown in FIGS. 2 and 3. The outer diameter of the lower portion 12 is preferably a little larger than the inner diameter of the upper portion 11, such that the butts and the ash on the bottom plate 22 of the body 2 may not be seen or be blown off by exterior wind and can scatter around hidden under the lower portion 12.

The body 2 is provided with an inner and an outer peripheral and bottom walls 231 and 232 to form a hollow space 23 between said walls for storing water 24 therein, and a central extinguishing tube 21 extending up from the hollow space 23 at the bottom. The central tube 21 has its bottom properly separated from the bottom of the outer wall 232 so that the water in the central tube 21 can be soaked up by the sponge even if the ashtray should be turned over or tilted. The central tube 21 has a central straight wall separating its interior into two portions 211 and 212 for receiving the sponge. When water is poured into the hollow space 23, one portion can receive the water and another portion can provide for air passage, thereby facilitating the filling space 23. Both portions 211 and 212 are extended in the hollow space 23, and the sponge placed therein can absorb the water in the hollow space 23 to the surfaces 2111 and 2121. When a cigarette butt is put thereon as shown in FIG. 2, it will be put out by the water.

What is claimed is:

1. An ashtray comprising:

a cap and a body;

said cap including a substantially round ring defining an upper portion and a substantially round plate defining a lower portion;

said body including a container for receiving ashes having an open end with a peripheral edge defining a perimeter of said open end;

said ring sitting on said peripheral edge of said body and having a plurality of crosswise recesses for placing cigaretts on the surface thereof, said ring including a plurality of feet extending down to and linking with plate, and said plate having a surface slanting radially down from its center to its peripheral edge and a central opening for an extinguishing tube to pass upwardly therethrough;

said body further including an inner portion and an outer portion each including a vertical peripheral and a horizontal bottom wall, said portions defining a hollow space between their respective walls and an extinguishing tube in fluid communication with said space and extending upward from said body through said opening in said round plate of said cap, said hollow space storing an extinguishing fluid therein, said tube having two portions separated by a central straight wall containing an absorbing means for absorbing said extinguishing fluid such that cigaretts placed on said absorbing means are extinguished.

2. The ashtray as claimed in claim 1, wherein said plate has a smaller outside diameter than the inside diameter of the inner portion of the body such that ash or cigarette butts in the ashtray are not blown out of said ashtray.

3. The ashtray as claimed in claim 1, wherein said extinguishing fluid is water.

4. The ashtray as claimed in claim 1, wherein said absorbing means is a sponge.

5. The ashtray as claimed in claim 3, wherein said absorbing means is a sponge.

* * * * *